United States Patent [19]

Dokoupil et al.

[11] 4,296,514

[45] Oct. 27, 1981

[54] METHOD FOR CONTINUOUS PROCESSING OF FLEXIBLE WORKPIECES

[76] Inventors: Jiri Dokoupil, Hochstrasse 9, 6251 Gückingen; Kurt Hacker, Birkenwaldstrasse 155, 7000 Stuttgart 1, both of Fed. Rep. of Germany

[21] Appl. No.: 128,977

[22] Filed: Mar. 10, 1980

Related U.S. Application Data

[62] Division of Ser. No. 904,496, May 10, 1978.

[30] Foreign Application Priority Data

May 17, 1977 [CH] Switzerland ..... 6167/77
Dec. 27, 1977 [DE] Fed. Rep. of Germany ..... 2758349

[51] Int. Cl.[3] ..... A43D 9/00
[52] U.S. Cl. ..... 12/142 R; 12/1 A
[58] Field of Search ..... 12/146 R, 1 A, 41.2, 12/41.3

[56] References Cited

U.S. PATENT DOCUMENTS 1,673,826 6/1928 Hunt ..... 12/1 A
2,094,007 9/1937 Fickett ..... 12/41.2
3,332,415 3/1968 King ..... 12/142 R

FOREIGN PATENT DOCUMENTS 927212 10/1947 France ..... 12/41.3

*Primary Examiner*—Patrick D. Lawson
*Attorney, Agent, or Firm*—Werner W. Kleeman

[57] ABSTRACT

A method for the continuous processing of laminar flexible workpieces, especially in the production of leather, shoes or clothing is disclosed. The method involves the pressing, especially hot-press gluing of workpieces wherein the workpieces are conveyed along a continuous path in pressure zones comprising at least one low-pressure zone on the input side for spreading or smoothing the workpieces and at least one succeeding high-pressure zone for pressing the workpieces. The workpieces are preferably conveyed in a generally upwardly direction from the inlet toward an outlet generally superposed above and in a direction opposite the inlet feed of the workpieces.

8 Claims, 16 Drawing Figures

METHOD FOR CONTINUOUS PROCESSING OF FLEXIBLE WORKPIECES

CROSS-REFERENCE TO RELATED CASE

This application is a divisional application of our copending U.S. application Ser. No. 904,496, filed May 10, 1978.

BACKGROUND OF THE INVENTION

The present invention refers to a method of continuous processinng of laminar flexible workpieces, especially in leather, shoe or clothing production, with pressing, especially hot-press gluing of the workpieces, where the workpieces are carried through at least one low-pressure zone and subsequently through at least one high-pressure zone. The invention further refers to a method of continuous processing of workpieces of the aforesaid kind with automatic depositing or stacking. Again, the object of the invention includes devices for performance of such methods.

The gluing of laminar flexible workpieces is effected, e.g. in shoe production often still by long known round plate pressing in which pairs of plates connected to a lifting press are turned in steps about a vertical axis and so come from a loading station at which one pair of plates at a time is run apart and enables the insertion of a pair of workpieces for gluing, to a pressing or heating station with hot-press gluing of the pair of workpieces and again back to the loading station.

These devices and the method performed by them are costly because the loading especially of workpieces of large area is relatively lengthy and imposes some demands for dexterity by the attendant. Working speed and in the case of difficult nature of the workpiece also the quality of work as regards freedom from wrinkles and uniform gluing therefore leave much to be desired.

Again, tests have already been made with gluing presses which exhibit a flat straight-line continuous path for the workpieces, with a conveyor belt. Here the loading station is separated spatially from the removal station and because of the heating and pressing station lying between them is relatively far removed, which makes operation more diffiult and in general makes additional personnel necessary.

Further, there is known from the West German Patent Publication No. 2,413,672 a continuous method of hot-pressing workpieces for purposes of proof printing and a corresponding drum press with a circulating conveyor belt. There the entry of the workpieces into the continuous path is effected at the peak of the drum in the region of a first roll, on account of which the workpieces come relatively rapidly under high pressure and can easily form wrinkles. For the processing of softly flexible workpieces such as in leather, shoe and clothing production, this process because of the formation of wrinkles is not very suitable. Furthermore, the continuous path for the workpieces is traversed preponderantly in a descending direction, so that the outlet point lies below the inlet point. Therefore an extensive additional section of the conveyor belt is necessary in order to bring the workpieces from the region of the feed station lying above and to be able to release them. Furthermore, to do this conveyance upwards is necessary. But this section of the conveyor device again impedes accessibility at the front of the feed station, which has the result of laborious operation.

SUMMARY OF THE INVENTION

A primary object of the invention therefore is the creation of a continuous method of pressing which is distinguished by simple operation, high working speed and a wrinkle-free processing process. The solution of this problem is in accordance with the invention characterized as regards the method by the features specified in the appended claims.

Hence, by the successive low-pressure and high-pressure action upon the workpieces it is ensured in a simple manner that upon introduction possibly existing wrinkles get smoothed out before the gluing in the high-pressure zone. For the manual insertion and introduction of the workpieces, therefore, only a small time needs to be spent without the uniformity of the gluing and the shape of the workpiece being impaired. The outlay on operation is further reduced in particular in that feed and outlet of the workpieces because of the essentially rising traversing motion and because of the inlet and outlet motions in opposite directions can be effected on the same side of the machine. Feed and removal of the workpieces can thus be dealt with, practically without spatial separation, i.e. united at one operating station, so that in general only one operator is necessary.

As regards the device for the solution of the problem posed, it proves particularly advantageous to deal with the spatial deflection of the traversing motion between inlet and outlet with the rising section of motion arranged between them, at the periphery of a conveyor drum with a conveyor belt lying against it, because this enables minimization of the cost outlay for the apparatus. For the spreading out or smoothing of the workpieces it is in that case important that they are laid flat lightly on the inside—i.e. on the surface facing the periphery of the drum—of the strand of the conveyor belt running onto the drum, and subsequently drawn in out of this flat position because of the relatively large diameter of the drum—into the very slowly tapering, wedge-like inlet gap between the belt and the drum periphery. Likewise essential is the low-pressure zone connected to it, formed by the belt tension, within which in a simple way further spreading out and smoothing occurs befoe the actual gluing and fixing of the pair of workpieces. This is then effected, again in an advantageously simple way, by means of a pressure roll which—directly or via the conveyor belt—acts against the periphery of the drum and because of its relatively small diameter readily yields a high surface pressure for the gluing.

The object of the invention extends further to the creation of an advantageous method of depositing or stacking and of a corresponding device, such as are in general necessary in the case of continuous processing or continuous pressing of the present kind.

For the stacking of workpieces in the leather and clothing industry, mechanisms are known which are distinguished by complicated construction and like method cycle with correspondingly high outlay on structural means and processing time. The operating reliability too is relatively low because of the complicated construction of the carriage movable by reversing rodding, conveyor belts for rolling off and such like operating mechanisms. An object of the invention is therefore furthermore the creation of a method for the continuous processing of laminar flexible workpieces with automatic depositing or stacking, which is distinguished by simple work cycle and construction and corresponding reliability as well as low outlay. The corresponding solutions are characterized by the features in accordance with the appended claims.

The features herein specified enable secure taking up of the workpieces, largely independently of the kind of transfer or of the output conditions of the machine connected in front. Then there follows a secure onwards conveyance of the workpieces under the action of suction against the conveyor belt, that is, independently of the outline shape of the workpieces as well as even for workpieces of particularly large area. The depositing can subsequently be initiated at a predetermined point with great accuracy by cutting off the suction effect which enables stack formation accurately to shape.

A particularly advantageous combination of features results from combination of the feature of the method concerning the pressing of flexible workpieces in continuous operation with the features which in accordance with the method and device claims concern the depositing or stacking of the workpieces. Through construction of the continuous path for the workpieces according to the first-mentioned aggregate of features with motion of the workpieces from the front at the bottom to the front at the top, without special structural measures sufficient room is presented for the accommodation of a stacking device, especially one having a receiver table which is moved progressively downwards or the like, connected to the output station of the continuous pressing method or the continuous drum-press. In particular without detriment to the free accessibility and easy operation of the feed station of the continuous press the stacking device may be arranged above the feed, without impeding attendance.

In the case of treatment of materials permeable by air such as for example, materials for clothing, a very advantageous cooling-off effect occurs with simultaneous conveyance against the suction belt.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
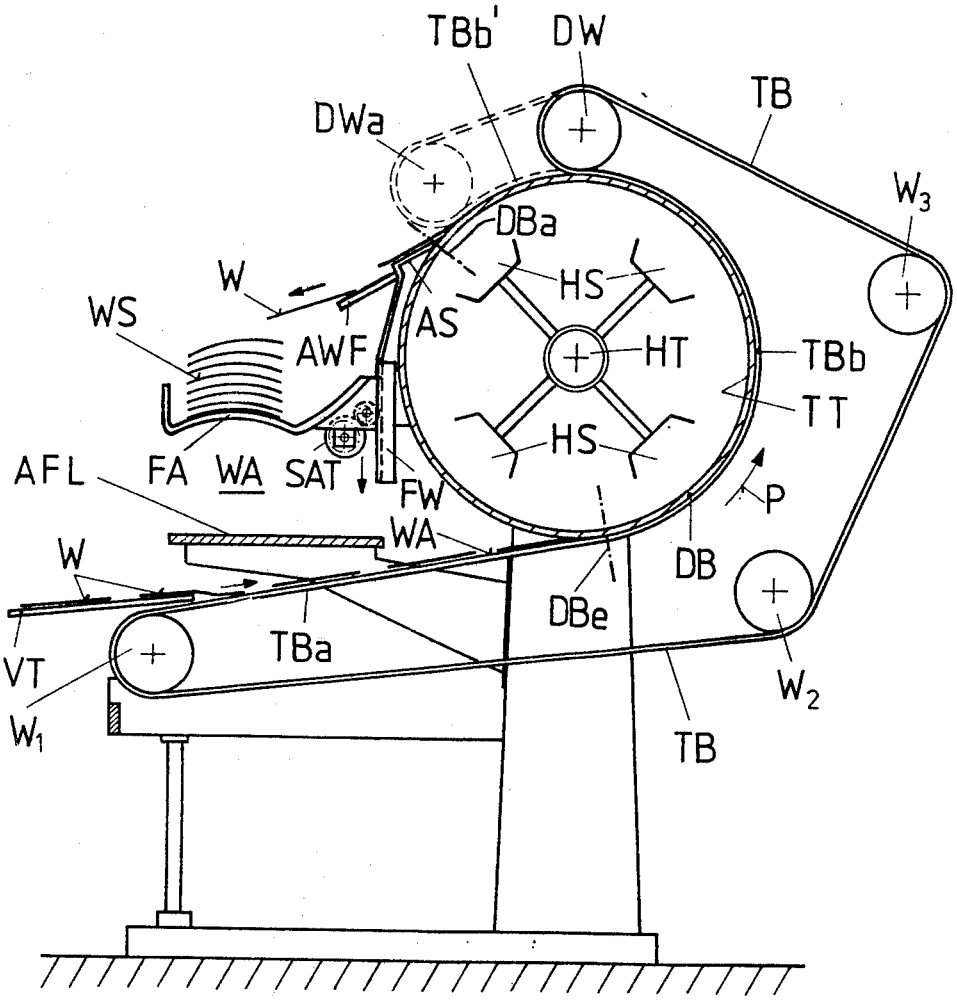
FIG. 1 is a vertical section of a continuous drum-press having a conveyor belt wrapped around it and a dropping workpiece-discharge receiver, in accordance with a plane of section transverse to the axis of the drum.

In cross-section in accordance with FIG. 1 a continuous path DB for workpieces W may be seen, which extends—essentially between the surface of a conveyor drum TT and a conveyor belt TB partially wrapping it—in the direction of rotation of the drum in accordance with the arrow P from an inlet point DBe at the underside of the drum up to an outlet point DBa at the top side of the drim primarily in a rising direction along the periphery of the drum. The conveyor belt is led back on itself to circulate endlessly over guide-rolls $W_1$, $W_2$ and $W_3$ as well as a pressure roll DW arranged in the region of the upper peak of the drum, which simultaneously acts as guide-member. The run or strand TBa of the conveyor belt, running onto the lower periphery of the drum, forms by its surface facing the periphery of the drum a workpiece feed support WA over which workpieces or respectively pairs of workpieces W placed in readiness on a preparatory table VT come to the inlet point DBe at the end of a wedgelike inlet or nip. In the region of this inlet point the conveyor belt, under only its longitudinal tension which, e.g. is generated by means of spring loaded rocking levers SH against the bearing of the guide roll $W_2$ in accordance with FIG. 2, lies against the periphery of the drum or respectively against the workpieces, so that at the inlet point a gentle rise in pressure with excellent smoothing and spreading action occurs. This action continues in a succeeding low-pressure zone which is formed by the rising strand TBb of the conveyor belt and at the point of influence of the pressure roll DW turns into a high-pressure zone. Here the actual gluing takes place. In case of necessity a number of such pressure stations may be arranged with high-pressure zones one after another, perhaps also alternating with low-pressure zones. In this way difficult workpieces as well as unfavorable gluing conditions can be controlled too.

Figure 2:
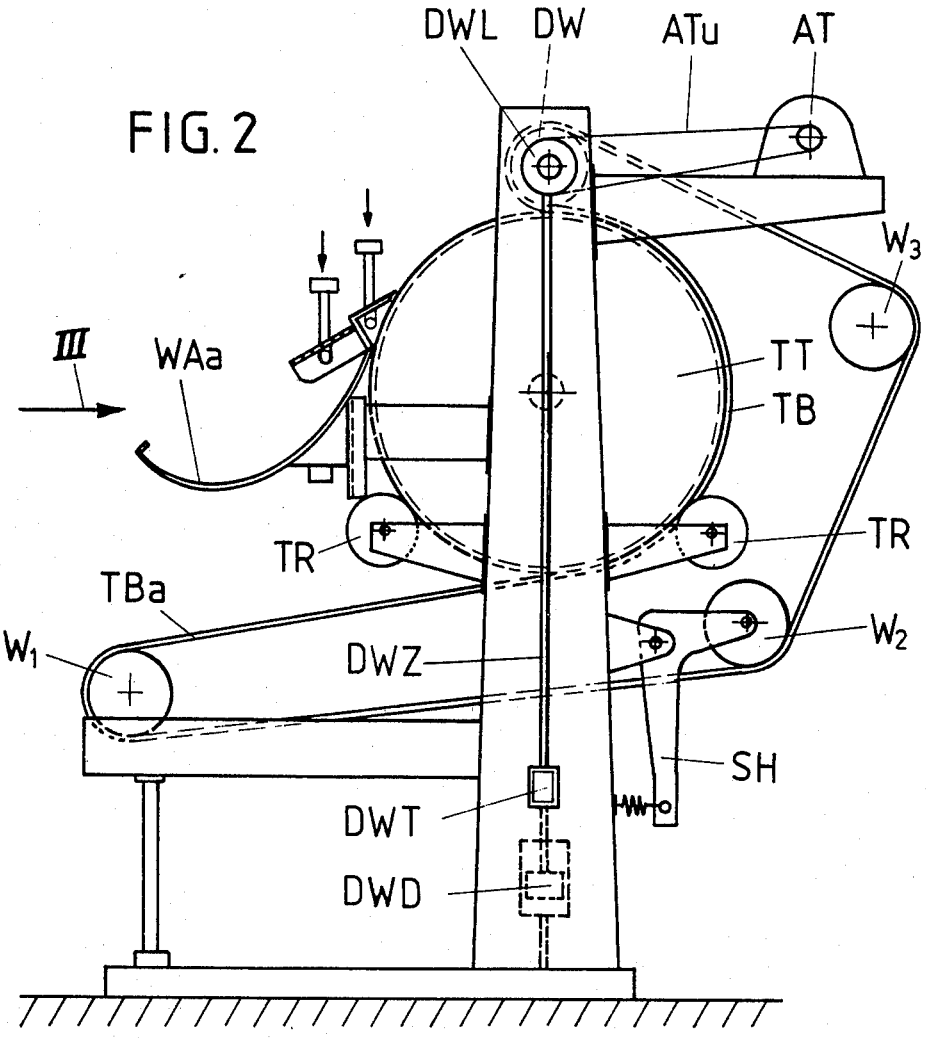
FIG. 2 is a side elevation looking in a direction parallel with the axis of the drum of a continuous press similar to the execution as FIG. 1, but having pneumatic stripping of the workpieces and like discharge guide with a stationary discharge receiver.

A particularly simple drive results in accordance with FIG. 2 if the pressure roll DW is coupled, on the one hand, via a belt or chain drive ATu to a driving unit AT and, on the other hand, transmits its rotary motion by friction onto the conveyor belt as well as via this to the conveyor drum.

As shown in FIG. 1, at the outlet point DBa from the continuous path for the workpieces a stripping station is arranged, having a knife-like stripper AS inclined at an acute angle towards the drum periphery. This stripper releases the workpieces W sticking to the drum after the gluing, carefully from the drum surface. The stripper station is arranged at the upper section of the drum periphery, and is inclined downwards, looking in the direction of rotation, that is, approximately in the center of the upper quadrant of the drum periphery at the feed side, so that the discharge motion is effected approximately in the direction of the feed station with the preparatory VT and may readily be observed and supervised by the person operating the feed. Instead of or in addition to the pressure roll DW another pressure roller DWa with a corresponding strand TBb' of conveyor belt may be advanced or extended up to the outlet point DBa. By doing this an additional or a longer low-pressure zone or an additional high-pressure zone is gained, whilst on the other hand the stripping by the stripper may lead to sharper bending of the workpiece.

A likewise downwards sloping discharge guide AWF is connected to the stripper with a step down, and over it the workpiece being stripped at the time arrives in the region of the workpiece receiver FA arranged above the workpiece feed support WA. Here follows the formation of a stack WS of workpieces, which likewise can be readily observed by the attendant at the same time and where necessary corrected. Removal of a stack during the working process is possible too, practically without interruption to the feed.

The workpiece discharge receiver FA is supported to be vertically slidable on a guide FW and connected to a lowering drive SAT indicated only diagrammatically, as well as a lowering control adaptable to the operating speed and stack formation, of a usual kind or one which suggests itself, so that the actual discharge is effected always with about the same drop and uniform formation of the stack is guaranteed.

Further, the receiver FA exhibits a section of curved shape—here, e.g. convex upwards—which enables corresponding shaping of the discharged workpieces directly in connection with the gluing, i.e. in general before the setting of the glued pair of workpieces. During the formation of the stack the setting can take place, so that the non-plane shape achieved in the workpieces is preserved at least partially after removal. Such performing of workpieces is of particular significance in shoe production.

In accordance with FIG. 1 an advantageous refinement exists further in the arrangement of an additional working surface AFL at the region between the workpiece feed support WA and the stripper station or workpiece receiver FA for purposes of prearranging different workpieces to be glued in the same working process.

For purposes of the hot-press gluing usually to be applied, in accordance with FIG. 1 a heater is arranged inside the conveyor drum TT, here having four heating radiators HS distributed about the periphery, which are mounted stationary and supplied with heating current via a likewise stationary mounted supporting arrangement HT. The drum correspondingly consists of material capable of conducting heat well for transfer of the heat onto the workpieces within the conveying path or through passageway. Where necessary for heating-up on both sides and also for preheating, a conveyor belt TB capable of storing heat is employed and heated up by the jacket of the drum TT.

In the case of different thicknesses of workpiece within a pair the thinner workpiece is advantageously brought to the side next to the belt which is heated indirectly and therefore transmits less heat to the workpiece. Preheating is then effected, e.g. within the workpiece feed support WA, whilst heating up to the gluing temperature is effected during the traverse of the said low-pressure zone. Further, it is of significance that the traverse of the workpieces through the pressure zones, especially through the high-pressure zone, is effected between a rigid pressure surface on one side, namely, the surface of the drum, and a yielding pressure surface on the other side, namely the surface of the belt on the drum side, hence irregularities such as stitches and the like cannot cause any too marked non-uniform pressure distribution. For that purpose it is particularly advantageous to employ a conveyor belt softly compressible in its wall thickness.

Figure 2A:
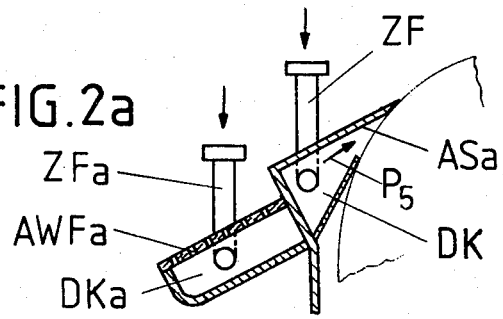
FIG. 2*a* is a detail from FIG. 2 concerning workpiece stripping and discharge guidance.
Figure 3:
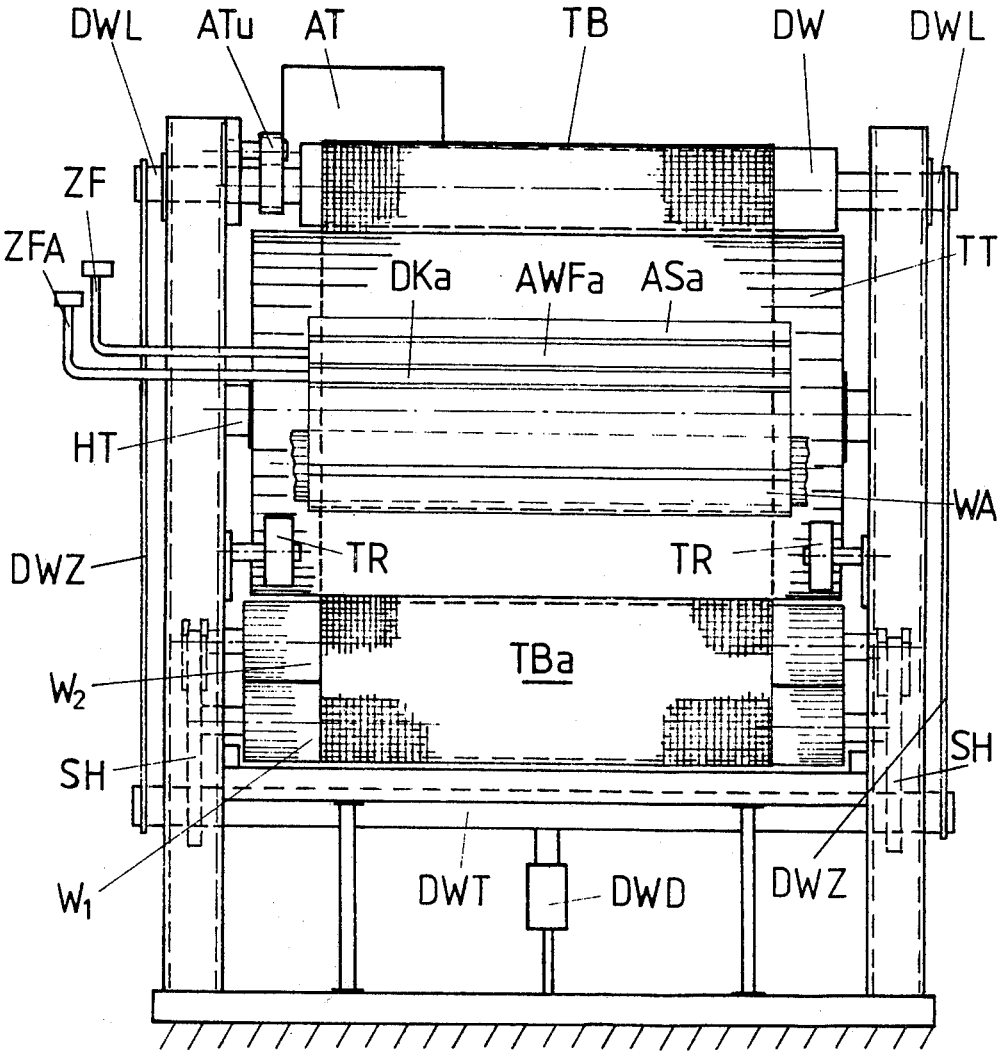
FIG. 3 is a front elevation of the continuous press as in FIG. 2, looking in the direction of the arrow III in FIG. 2.

The embodiment as FIGS. 2, 2*a* and 3 exhibits, deviating from the preceding one, a workpiece discharge receiver WAa which is fixed or adjustable for height, but in accordance with FIG. 2*a* a stripper ASa consisting of a pressure chamber DK acted upon from below by compressed air and provided with a corresponding feed ZF and a similar discharge guide AWFa made as a perforated plate with a pressure chamber DKa and feed ZFa. This embodiment allows even in the case of workpieces sticking rather hard to the drum of certain and gentle stripping and a discharge guide free of adhesion.

In FIGS. 2 and 3 again there is shown a particularly simple and secure floating support of the conveyor drum TT between roll members arranged essentially opposite one another at its periphery, namely, between the pressure roll DW on the one hand and on the other hand two pairs of bearer rollers TR which engage the drum on both sides of the belt TB. Further, for the pressure roll DW a pressure mechanism which is independent of the displacement and engages the center of the pressure roll symmetrically on both sides is indicated, having pullrods DWZ linked to the roll bearings DWL and an equalizer crossbar DWT which connects the bottom ends of the rods, and with which engages a travel-independent pressure member DWD, e.g. a weight or a fluid-fed pressure cylinder. For this purpose with a view to easier adjustability or more accurate maintaining of force of contact a controllable or regulatable fluid feed may be provided.

Essential to the design and operation of the continuous press in accordance with the invention is a construction in such a way that from the inlet point of the continuous path for the workpieces at the lower section of the periphery of the conveyor drum up to at least in the upper peak region of the conveyor drum at least one strand of the conveyor belt is provided, which lies against the periphery of the drum and with the rotation of the drum moves in the direction from the lower peak of the drum to the upper. This provides the required relative position of the feed station and delivery station or respectively transfer station to the stacking device connected after it, with adequate room for the latter, in which case the heating-up of the workpieces may be effected particularly advantageously from the interior of the drum via its heat-conductive jacket. In that case where necessary a number of conveyor belts may be provided at the periphery of the drum, that is, not only in series connection as regards the rotation of the drum, in which case the workpieces arrive successively in the region of the different belts. On the contrary, in particular even two belts may be provided lying radially one on top of the other on the drum periphery, between which the workpieces are conveyed and pressed. One of the belts then lies directly on the periphery of the drum and where necessary transmits to the workpieces the heat necessary to the pressing or gluing process.

With the aid of FIGS. 4 to 15 the operation and design of different depositing or stacking devices in accordance with the invention is explained below, particularly in series connection with a drum press of the kind described above.

Figure 4:
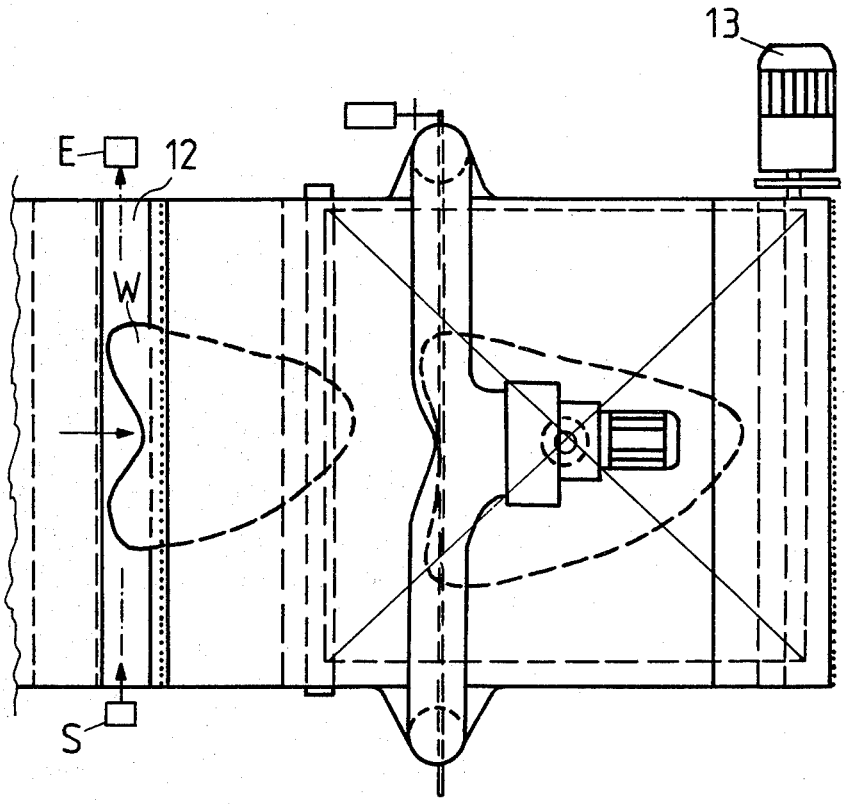
FIG. 4 is a plan of the outlet station of a continuous drum-press with a stacking device connected after it in accordance with the invention.
Figure 5:
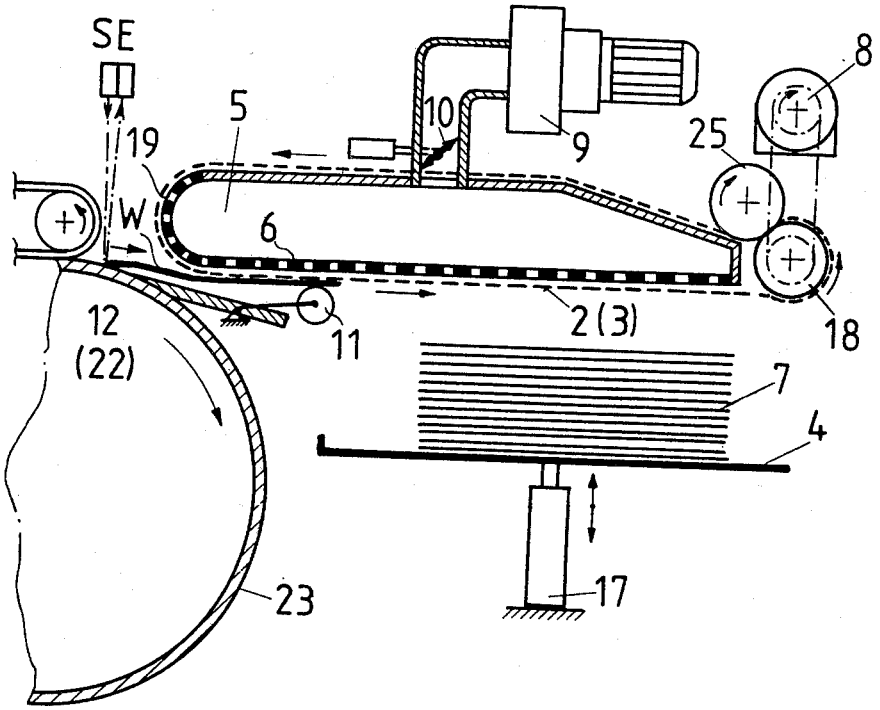
FIG. 5 is a side elevation-sectional illustration of the device as FIG. 4.

The method of depositing or stacking in accordance with the invention works, e.g. in accordance with FIGS. 4 and 5 so that the workpieces W are taken up by means of at least one conveyor belt 2 permeable to air or conveyor belts 3 arranged side by side, and conveyed to the depositing point 4, that is, in such a way that the workpieces are sucked by means of reduced pressure against the conveyor belt 2 or 3 and at the depositing point 4 the action of the reduced pressure stops. The workpieces W here become free of the conveyor belt 2 or individual conveyor belts 3 and form a stack 7.

The design and operation of the stacking device in accordance with the invention result with the aid of FIGS. 4 and 5 as follows:

A conveyor belt 2 permeable to air runs about a reduced pressure container 5 having a perforated wall 6, and is coupled to a geared motor 8 as the drive. The reduced pressure container 5 is connected by a connection to a reduced pressure generator, e.g. a fan 9 or a number of them. A throttle valve 10 is built into this connection, which is used for interruption of the action of the reduced pressure on the workpiece W. A scanning roller 11 is arranged against the conveyor belt 2 and a depositing point 4 is available for the stack 7.

The stacking device works as follows:

The workpieces W, e.g. parts for shoes, are conveyed out of an operating machine, in this case, e.g. out of a drum press and at a transfer point 12 (in this case the transfer point is at the same time the stripper 22 from the drum 23) fed to the conveyor belt 2. The workpieces W by means of reduced pressure which also acts through the belt 2 on the workpieces W, are sucked against the belt 2. In the state sucked against the belt the workpieces run past under the scanning roller 11. Electrical pulses which arise from the motion of the scanning roller are delayed in time and are used for the control of the throttle valve 10 which interrupts the action of the reduced pressure when the workpieces W lie above the depositing point 4.

Then at the same time in this position the motion of the conveyor belt 2 is brought to rest, that is, by means of a brake 13. Idler roll 25 helps maintain the conveyor belt 2 in contact with the reduced pressure container 5. The workpieces fall by gravity into exact position on the stack 7. For higher stacks or for a still more accurate working process it is advantageous to control the height of the depositing point 4 by, e.g. pneumatic means 17.

Figure 6:
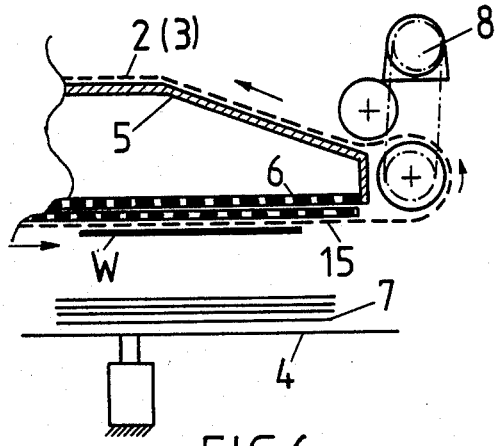
FIG. 6 is a further embodiment of a stacking device in accordance with the invention having a modified mechanism for control of the depositing, in side elevation-sectional illustration corresponding with FIG. 5.
Figure 7:
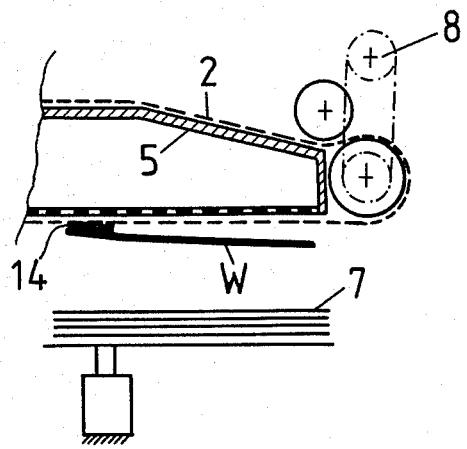
FIG. 7 is a further modification of the depositing control or respectively interruption of the force of suction in an illustration corresponding with FIG. 6.
Figure 8:
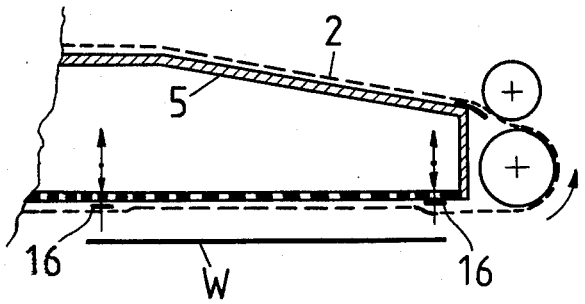
FIG. 8 is a further embodiment of the stacking device with depositing control, again in a manner of illustration corresponding with FIG. 6.

In FIGS. 6, 7 and 8 alternatives for the interruption of the action of the reduced pressure-force of suction on the workpieces are shown in the position above the depositing point 4. In accordance with FIG. 6 a perforated intermediate plate 15 is provided, which covers over the openings in the perforated wall 6 at the instant of depositing.

In accordance with FIG. 7 a mechanical stripper 14 is provided, which raises the workpieces mechanically from the conveyor belt 2 and thus interrupts the action of the reduced pressure on the workpieces W. In accordance with FIG. 8 two belt-raisers 16 are arranged under the conveyor belt 2, which at the instant of depositing raise the conveyor belt 2 from the perforated wall in reduced pressure container 5 and thus free the workpieces from the action of the reduced pressure.

Figure 9:
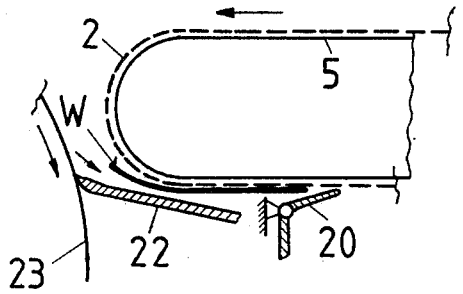
FIG. 9 is the receiver part of a stacking device having a control feeler for the detection of the speed of conveyance for the purpose of synchronization of the depositing process.
Figure 10:
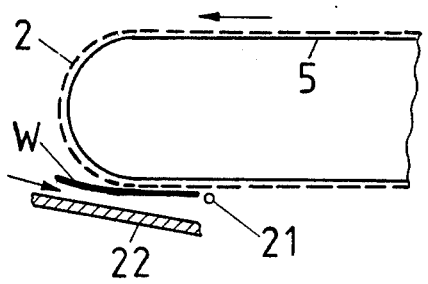
FIG. 10 is a modification of the synchronous control for the depositing process in a manner of illustration corresponding with FIG. 9.

In FIGS. 9 and 10 variants upon a control mechanism for the synchronization of the depositing process with the run of the belt are illustrated. FIG. 9 shows a swingable seesaw 20 and FIG. 10 a light-barrier 21 which runs transversely to the direction of feed and triggers a control pulse at its interruption.

In FIG. 4 such a light-barrier with transmitter and receiver is indicated in plan, with the path of its beam lying in the plane of the workpieces. Likewise a reflection light-barrier SE is indicated diagrammatically in FIG. 5 may be applied, the beam path of which from the transmitter strikes the reflecting surface of a workpiece-conveying or workpiece-guiding surface in the inlet region of the stacking device and returns from this surface to the receiver part of the light-barrier. The contour of the workpieces thereby gets scanned, for example, the rear contour as indicated in FIG. 5, or else the front edge. In either case a time-determination results, by means of which, taking into consideration known facts or as mentioned, by means of a special scanning roller or the like the measured speed of the workpiece, the exact instant for interruption of the force of suction for the depositing process may be determined.

Figure 11:
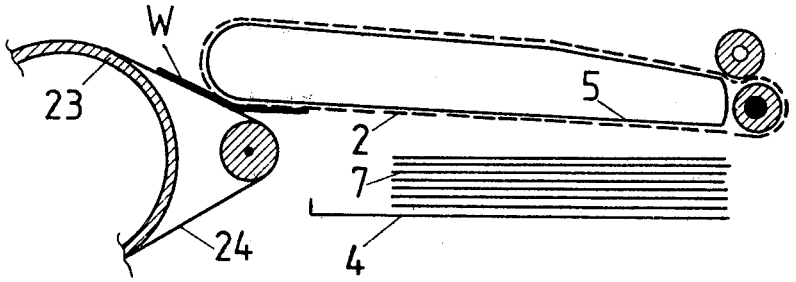
FIG. 11 is a diagrammatic side elevation-sectional illustration of a whole stacking device with a drum press preceding it and associated discharge belt as transfer point for the workpieces.

In FIG. 11 a transfer point is illustrated, that is, a delivery belt 24, e.g. a delivery belt from a drum reversing ironing machine. In the case of this alternative the workpieces may very advantageously be taken over by means of the belt 2 and the reduced pressure, from the surface of the delivery belt 24.

Figure 12:
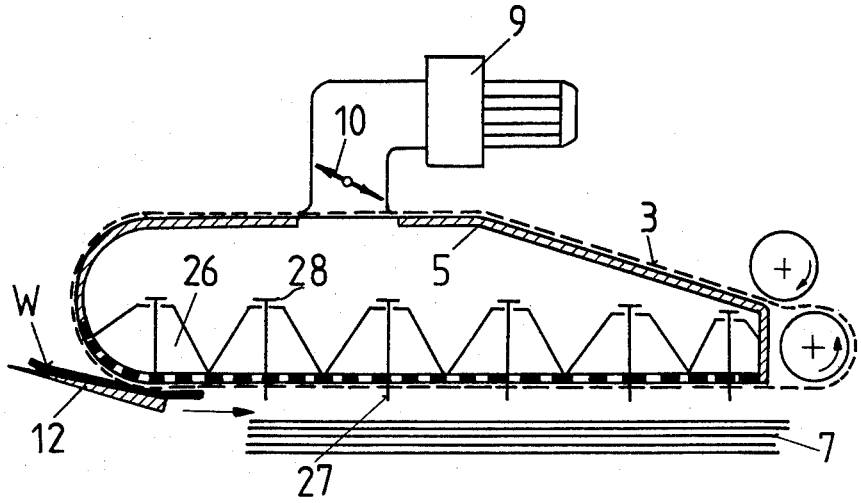
FIG. 12 is a further development of the stacking device in accordance with the invention for large workpieces in a side elevation-sectional illustration corresponding with FIG. 5.
Figure 13:
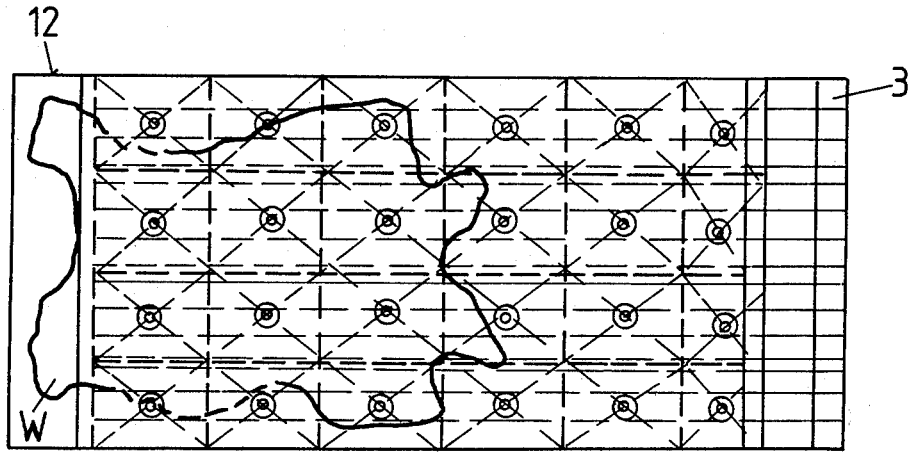
FIG. 13 is a plan of the deivce of FIG. 12.

In FIGS. 12 and 13 an interesting alternative is illustrated, which mainly in the case of the depositing of large skins enables the employment of the principle of the invention. The reduced pressure container 5 is divided up into individual part-chambers 26 associated with the perforated wall 6, which are connected to the reduced pressure generator 9 to correspond with the outline of the workpieces in dependence upon the progressive motion of the workpieces. With this arrangement it is possible even with relatively low air consumption to convey large workpieces (e.g. whole skins) by means of the reduced pressure.

Figure 14:
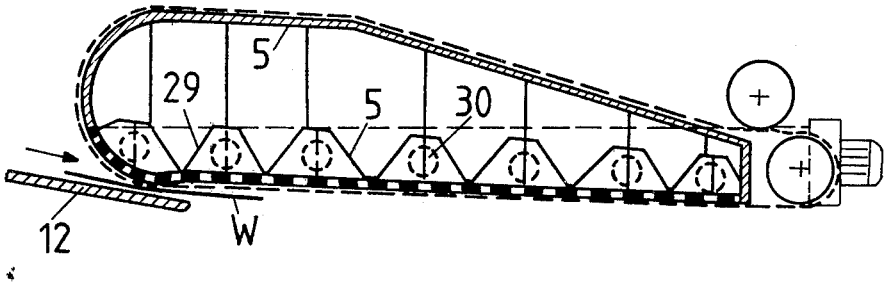
FIG. 14 is a side elevation-sectional illustration of a further embodiment of a stacking device for fairly large workpieces.
Figure 15:
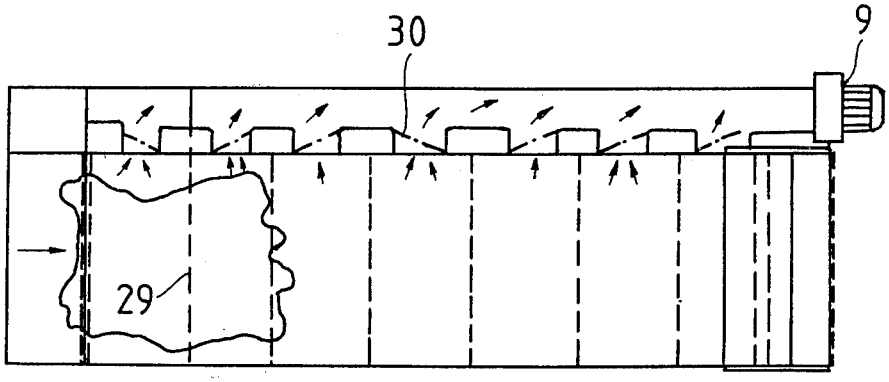
FIG. 15 is a plan of the device of FIG. 14.

In the case of small skins, e.g. the pelts of small animals, the reduced pressure container 5 may in accordance with FIGS. 14 and 15 be divided up into part-chambers running transversely. These part chambers are then connected continuously to the reduced pressure generator, that is, in association timewise with the motion of the workpieces. The individual transverse chambers are connected one after the other to the reduced pressure generator by, e.g. valves 30 which again are controlled, e.g. by means of electromagnetic valves.

Referring back to FIG. 5, one may see that the drive means for the second conveyor belt 2 comprises only one driving roll 18 and a curved stationary surface 19 over which the workpieces W are deflected at a transfer point 12 onto the second conveyor belt 2.

Also, in FIG. 9, the workpiece transfer point 12 comprises a stationary stripper 22 and a drum-ironer 23 having a heated drum surface.

In FIG. 11, the workpiece transfer point 12 comprises a drum-ironer 23 having a third conveyor belt 24.

In FIG. 12, a control means is provided for connection of the part-chambers 26 to the reduced pressure generator 9. This control means includes control valves 28 associated with a respective part-chamber 26 and mechanical feelers 27 for activating the control valves 28.

Although only preferred embodiments are specifically illustrated and described herein, it will be appreciated that many modifications and variations of the present invention are possible in light of the above teachings and within the purview of the appended claims without departing from the spirit and intended scope of the invention.

What we claim is:

1. A method of continuous processing of laminar flexible workpieces, especially in leather, shoe or clothing production, with pressing, especially hot-press gluing of the workpieces, where the workpieces are carried through at least one pressure zone, characterized in that a continuous path of the workpieces comprises at least one low-pressure zone on the input side for spreading or smoothing the workpieces and at least one succeeding high-pressure zone for pressing the workpieces traversing the path from the input side in a generally upwardly direction toward an outlet side with an outlet motion of the workpieces essentially in the opposite direction to and spatially above the infeed motion of the workpieces.

2. A method as in claim 1, characterized in that a heating-up of the workpieces is effected before entry into the high-pressure zone and during traversal in a low-pressure zone.

3. A method as in claim 2, characterized in that the heating-up of a pair of workpieces is effected between pressure-faces which are heated to a different degree corresponding with different thicknesses of the workpieces.

4. A method as in claim 1, characterized in that the workpieces at the outlet side of the continuous path are ejected in a generally downwardly inclined direction.

5. A method as in claim 1, characterized in that the workpieces are taken up by means of a reduced pressure on one side of at least one conveyor belt permeable to air and conveyed to a deposit point at which the reduced pressure is cut off and the workpieces are released from the conveyor belt for the formation of a stack.

6. A method as in claim 1, characterized in that the workpieces are taken up by means of a reduced pressure on one side of at least one conveyor belt permeable to air, conveyed to a deposit point, and cooled by means of the air flowing through, the reduced pressure being cut off at the deposit point and the workpieces being released from the conveyor belt for the formation of a stack.

7. A method of continuous processing, especially for the hot-pressing or gluing of laminar flexible workpieces, especially in shoe production or textile processing, in which the workpieces are conveyed through at least one low-pressure zone with spreading out and/or smoothing of the workpieces and subsequently through at least one high-pressure zone, characterized in that the workpieces are fed in a continuous path from an inlet point in a generally rising direction to an outlet point with an outlet motion of the workpieces essentially in the opposite direction to and above the feed motion, that the workpieces are taken up at the outlet point from the continuous path by means of a reduced-pressure conveyor means, conveyed to a deposit point and released at the deposit point by at least partial cut-off of the reduced pressure.

8. A method as in claim 7, characterized in that the release of the workpieces with cut-off of the conveying motion is effected by introduction of a depositing motion at least approximately transversely to the path of conveying motion.

* * * * *